US006893390B1

(12) United States Patent
Mackin

(10) Patent No.: US 6,893,390 B1
(45) Date of Patent: May 17, 2005

(54) MOVABLE CANOPY FOR INFANT CARE APPARATUS

(75) Inventor: Michael H. Mackin, Ellicott City, MD (US)

(73) Assignee: Datex-Ohmeda, Inc., Madison, WI (US)

( * ) Notice: Subject to any disclaimer, the term of this patent is extended or adjusted under 35 U.S.C. 154(b) by 44 days.

(21) Appl. No.: 10/736,660

(22) Filed: Dec. 16, 2003

(51) Int. Cl.[7] ..... A61G 11/00
(52) U.S. Cl. ..... 600/22; 5/603
(58) Field of Search ..... 600/21–22, 26–28; 5/5, 600, 603, 81.1 R

(56) References Cited

U.S. PATENT DOCUMENTS

| | | | | |
|---|---|---|---|---|
| 3,858,570 | A | | 1/1975 | Beld et al. |
| 4,750,474 | A | | 6/1988 | Dukhan et al. |
| 4,936,824 | A | | 6/1990 | Koch et al. |
| 5,474,517 | A | | 12/1995 | Falk et al. |
| 6,022,310 | A | * | 2/2000 | Goldberg et al. ..... 600/22 |
| 6,213,935 | B1 | | 4/2001 | Mackin et al. |
| 6,224,539 | B1 | | 5/2001 | Jones et al. |
| 6,709,384 | B1 | | 3/2004 | Donnelly et al. |

* cited by examiner

*Primary Examiner*—John P. Lacyk
(74) *Attorney, Agent, or Firm*—Roger M. Rathbon

(57) ABSTRACT

An infant warming apparatus for supporting an infant upon an infant platform. A radiant heater is located above the infant platform at one end thereof. A canopy covers the infant platform and is movable between a closed position where the infant is enclosed and an open position providing access to the infant and/or the radiant heater can be energized to direct infrared energy toward the infant platform. The canopy is constructed of two sections, one of which is pivotally affixed with respect to the infant platform at or proximate the one end and the other section is movable relative the one section to create an open space so that when the canopy is pivoted to its open position past the radiant heater, the radiant heater is aligned with respect to the open space to allow the radiant energy to reach the infant platform without passing through the canopy.

20 Claims, 5 Drawing Sheets

MOVABLE CANOPY FOR INFANT CARE APPARATUS

BACKGROUND

The present invention relates to an infant care apparatus and, more particularly, to an infant warming apparatus having an overhead radiant heater and a pivotable canopy that is positioned over an infant.

In the care of newborn infants, there are various types of apparatus that provide heat to an infant and such apparatus can include infant incubators, infant warmers and combinations of the two. In such apparatus, there is normally provided, an infant platform on which the infant is positioned so as to receive the care and that infant platform is a generally planar surface located so as to underlie the infant. With infant warmers, there is also an overhead radiant heater that can be energized to direct energy in the infrared spectrum toward an infant resting on the infant platform to warm the infant.

In certain infant apparatus, there is also provided an infant compartment that encloses the infant and which can thereby form an enclosed area where the infant can reside within a controlled atmosphere where heat and possibly humidity are controlled so as to create a beneficial atmosphere for the wellbeing of the infant. That infant compartment is formed by the presence of a canopy located above the infant and which thereby encloses the infant resting on the infant platform.

An infant warmer is shown and described in U.S. Pat. No. 5,474,517 of Falk et al as prior art to that patent; an infant incubator is shown and described in U.S. Pat. No. 4,936,824 of Mackin et al and a combination apparatus that combines the functions of both an infant warmer and an infant incubator is shown and described in U.S. Pat. No. 6,224,539 of Jones et al.

As a further apparatus for caring for an infant, there can be a fixed heater mounted above the infant platform along with a movable canopy such as is shown and described in pending U.S. patent application Ser. No. 10/672,948 of Falk et al and entitled "Infant Care Apparatus With Fixed Overhead Heater" and the disclosure thereof is hereby incorporated herein in its entirety by reference. With that latter apparatus, there is a moving canopy however, the radiant heater itself is maintained in a fixed location.

One problem with the use of a canopy covering the infant to form the infant compartment, however, is that there are, obviously, times that the canopy must be opened in order to access the infant or to insert or remove the infant from that infant compartment. Therefore, there must be some means by which the canopy can be moved between a closed position where the infant compartment encloses the infant to an open position where the infant is accessible to carry out an intervention or procedure on that infant.

Accordingly, one convenient method that can be provided to allow the movement of the canopy between open and closed positions is by pivoting the canopy, preferable at one of its shorter ends of the generally rectangular footprint configuration and normally at the end that is herein defined to be the north end of the apparatus, that is, the end where there is normally located the various controls and monitors that are employed in carrying out the functioning of the apparatus and which is the end of the apparatus where the infant's head is conventionally located during the employment of the infant warming apparatus.

A difficulty arises, however, in pivoting the canopy at one end thereof between an open and a closed position is that there is often an overhead obstruction that is located above the infant platform such that the pivoting of the canopy about its north end is inhibited since the longer dimension of the canopy causes the canopy to encounter or hit the obstruction when the canopy is pivoted upwardly. With the apparatus described in the aforementioned patents and pending patent application, that overhead obstruction is the radiant heater that provides heat to the infant when located on that infant platform.

As such, therefore, the normal solid or one piece canopy cannot be readily opened with a pivoting motion about one of its shorter ends, since that canopy will physically encounter that obstruction and thus will be prevented from opening sufficiently to allow full access to the infant or to allow the apparatus to employ an overhead radiant heater to warm the infant.

It would, therefore be advantageous to have an infant care apparatus utilizing a canopy that is designed to be opened and closed, by pivoting about one end, where the canopy is specially constructed to function in the presence of a fixed overhead obstruction and yet which can be pivoted between open and closed positions without the obstruction unduly limiting the opening movement.

It would be further advantageous if that infant care apparatus were an infant warmer apparatus and the obstruction were the radiant heater used with that apparatus to provide heat to the infant.

SUMMARY OF THE INVENTION

Accordingly, the present invention relates to an infant care apparatus, such as an infant warming apparatus, that includes a base with an infant platform on the base for providing a support for an infant receiving care.

There is a canopy that is positioned atop of the infant platform and which is pivotally affixed with respect to the infant platform so that the canopy can be pivotally raised and lowered between, respectively, an open position and a closed position. There is also a radiant heater that is located at one end of the infant platform of the infant warming apparatus and which directs radiation in the infrared spectrum toward the infant platform to warm the infant when lying on that infant platform.

The pivot axis of the canopy is located at or proximate to the end of the infant platform where the radiant heater is located such that the other opposite end of the canopy can be raised and lowered about that pivot axis to move the canopy respectively, between its open and its closed positions. In the open position of the canopy, the caregiver has full access to the infant and also, the radiant heater can be energized to direct the radiant heat toward the infant on the infant platform. In the closed position the infant is enclosed within an infant compartment and heat and possible humidity controlled by a convective heating system.

With the present infant care apparatus, however, there is a specially designed canopy where an open space or opening can be created prior to or as the canopy is being raised from its closed position to its open position and that open space is dimensioned and oriented so as to align with the radiant heater, or other obstruction, that the canopy would otherwise encounter in pivoting the canopy upwardly to its open position. Thus, when the canopy is pivoted to its open position, the open space allows the canopy to be pivoted at least to, and preferably past, that radiant heater so that the radiant heater can direct the radiant energy toward the infant platform unobstructed by the canopy.

The creation of the open space in the canopy is accomplished by the construction of a canopy having two sections, that is, a first section and a second section. The first section is pivotally affixed to the infant care apparatus at a pivot axis that is fixed with respect to the infant platform and the second section is movable relative to the first section to form the opening or open space.

In one embodiment, the second section is slideably affixed to the first section such that the overall length of the canopy is reduced by sliding at least a portion of the second section to nest beneath the first section. That reduction in length allows the canopy to be pivotally raised such that the open space created by the shortened canopy is aligned with the radiant heater so that the canopy can be pivoted to, and preferably past, the radiant heater so that the radiant energy can be directed from the radiant heater to the infant platform without passing through the material of the canopy.

In essence, by moving the second section with respect to the first section, thereby creating an open space, the canopy can be pivotally raised so as to move past the radiant heater since the radiant heater is aligned with the open space, which was originally occupied by the second section, and thus clear the radiant heater so that the infrared energy can pass directly to the infant platform to warm an infant positioned thereon.

In another embodiment, the second section takes the form of a trap door that is hingedly affixed to the first section and is biased toward a closed position. Thus, when the canopy is pivoted to its open position, the biased trap door encounters the radiant heater such that further movement of the canopy causes the radiant heater to push the trap door open and thereafter extend through the opening thereby formed in the canopy. Again, therefore, due to the relative movement of the second section with respect to the first section, the radiant energy from the radiant heater can pass directly to the infant platform to heat an infant positioned thereon without passing through the material comprising the canopy.

With either embodiment, the canopy can be manually moved between its open and closed positions or, alternatively, may be powered by some motive means such as a motor, and in the embodiment utilizing the trap door, that trap door can also alternatively be opened and closed by a motive means such as a motor.

These and other features and advantages of the present invention will become more readily apparent during the following detailed description taken in conjunction with the drawings herein.

DETAILED DESCRIPTION OF THE INVENTION

Figure 1:
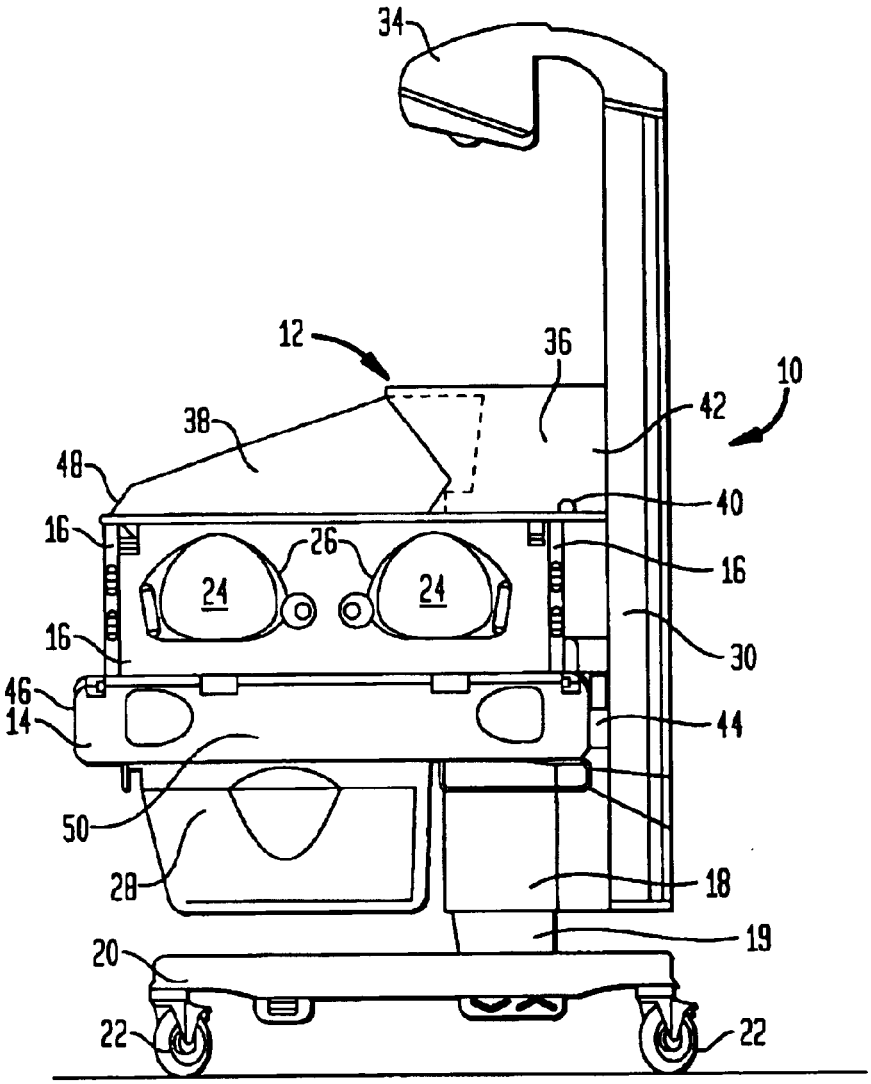
FIG. 1 is a side view of an infant care apparatus incorporating the present invention and showing the canopy in its closed position.

Referring now to FIG. 1, there is shown a side view of an infant care apparatus 10 constructed in accordance with the present invention having a canopy 12 located in its lower or closed position. In the position of the canopy 12, as shown, the infant care apparatus 10 acts as an infant incubator with relatively limited access to the infant, as compared to an infant warmer but with a controlled environment where the temperature and possibly the humidity and/or oxygen concentration is established and carefully maintained for the wellbeing of the infant.

As shown, the infant care apparatus 10 includes an infant platform 14 that underlies and supports an infant. As is also seen, a plurality of walls 16 are provided to contain the infant safely within the infant care apparatus 10 and are located at all of the four sides of the infant platform 14. The walls 16 are preferable constructed of transparent plastic material and, as will be explained, cooperate with other components in order to provide an incubator function when the infant care apparatus 10 is in the FIG. 1 configuration.

A convective heating system can be used with the present invention and can be a well known commercially system that uses forced convective air and one such system that can be used is shown and described in U.S. Pat. No. 6,213,936 of Mackin et al and the necessary apparatus for the convection heating system, such as a heater, fan, humidity control, air ducts and the like are normally located within the infant platform. The convective heating system circulates the heated air through the infant compartment that is formed when the present canopy 12 is in its closed position and the infant care apparatus 10 is carrying out the function of an incubator.

The infant platform 14 is mounted to a vertical base member 18 which, in the preferred embodiment, is movably affixed to a stationary base member 19 which in turn, is mounted to a base 20 having wheels 22 for ready movement of the infant care apparatus 10.

The vertical base member 18 is preferable mounted so that the user can adjust the height of the infant platform 14 by raising and lowering the vertical base member 18 as desired, thus the infant platform 14 can be adjusted to the preferred height by the user. As further standard features, the walls 16 have handholes 24 to afford access to the infant when in the incubator configuration of FIG. 1, and which generally have doors 26 and/or the walls 16, themselves, act as doors that can be opened to obtain access to the infant and, of course, closed when the particular intervention as been completed to preserve the desired environment surrounding the infant.

Another convenient feature includes a drawer 28 to retain supplies or other devices needed to carry out some operation on the infant and which is normally located beneath the infant platform 14. Other features include the maneuverability of the walls 16 that are pivotally mounted at their bases to the infant platform 14 such that the walls 16 can be swung outwardly and downwardly and as a further alternative, can be easily fully removed from the infant platform 14.

As such, therefore, when the canopy 12 of the infant care apparatus 10 is in its closed position as shown in FIG. 1, the walls 16 can be dropped downwardly or removed altogether so that the attending personnel can have access to an infant resting on the infant platform 14 to perform interventions on that infant.

Further structural components of the infant care apparatus 10 include a vertical frame member 30 (there may, of course, be more than one such vertical frame member) that is affixed to the base member 18. There may also be a control module (not shown) that can be affixed to the vertical frame member 30 or members and may include displays of various monitor parameters as well as include the various controls for operation of the functions of the infant care apparatus 10. The control module can be similar to or the same as shown and described in U.S. Pat. No. 5,474,517 of Falk et al.

A radiant heater 34 is located atop of the vertical frame member 30 and is held there in a fixed position with respect to the infant platform 14 so that the radiant heater 34 can always be focused so as to direct the infrared energy toward an infant that is located on the infant platform 14.

Turning now to the canopy 12, it can be seen that the canopy 12 is constructed in two sections, that is, there is a first section 36 and a second section 38. The first section 36 is pivotally affixed with respect to the infant platform 14 at pivot axis 40 that is basically located proximate to or at one end of the canopy 12. As used herein, the overall canopy 12 can be seen to have an end, which shall be referred to as the canopy north end 42 for convenience and which is located at the end of the infant care apparatus 10 where the vertical frame members 30 are located and from which the radiant heater 34 extends.

There would also normally be located the control module at that end and therefore the working components of the controls, monitors and the structural components that support the radiant heater 34 are located at the platform north end 44 of the infant care apparatus 10, taking the same convention as the canopy 12. In practice, the canopy north end 42 and platform north end 44 are also normally the orientation of the head of the infant.

Accordingly, the location of the pivot axis 40 is at or proximate to the canopy north end 42 and the pivot axis 40 is fixed relative to the infant platform 14 and may be fixed by brackets or other structural components that maintain the pivot axis 40 in that fixed location.

Oppositely disposed from the platform north end 44 is the platform south end 46 and a canopy south end 48 and the feet of the infant are generally oriented toward the platform south end 46 and canopy south end 48.

In the embodiment shown, the overall configuration of the infant platform 14, as well as the canopy 12 is generally rectangular such that the platform north end 44 and the platform south end 46 are both the shorter of the sides of the rectangle with lateral sides 50 that are the longer of the rectangular sides. The pivot axis 40 is thus, in the embodiment shown, along the shorter of the sides of the rectangular footprint of the infant platform 14 and the canopy 12.

Obviously, other configurations of infant platform 14, and mating canopy 12 can be utilized with the present invention including square configurations or even a circular or arcuate footprints, it only being of importance that one end or part of the canopy 12 be pivotally affixed with respect to the infant platform 14.

In FIG. 1, therefore, the second section 3B is movable relative to the first section 36 and can be slid in the direction toward the platform north end 44. The sliding relationship between the second section 38 and the first section 36 is carried out while the two sections remain joined together and the sliding relationship can be accomplished by conventional overlapping or interlocking lower edges of the second and first sections 38,36.

As can now be understood in FIG. 1, the canopy 12 can be pivoted about the pivot axis 40 by lifting the canopy south end 48 in order to gain access to the infant or to convert the infant care apparatus 10 from one functioning as an incubator to one functioning as an infant warmer and the radiant heater 34 energized to direct the infrared energy toward the infant platform 14.

However, due to the dimensions of the infant care apparatus 10, if the canopy 12 were a one piece or solid construction, the pivoting of the canopy 12 to its open position would cause the canopy 12 to encounter the radiant heater 34 which is an obstruction to the pivoting of the canopy 12 such that the angular pivoting of the canopy 12 is limited by that obstruction. Thus, the pivoting of the canopy 12 about the pivot axis 40 to allow the infant care apparatus 10 to energize the radiant heater 34 to provide warmth to an infant is prevented since the canopy 10 cannot pivot past the radiant heater 34, thereby preventing a direct pathway for that infrared energy from the radiant heater 34 to the infant resting on the infant platform 14.

As can be seen, the canopy 12 must pivot to, or preferable past, the radiant heater 34 in order for the radiant energy to emit from the radiant heater 34 to the infant platform 14 without passing through the plastic material of the canopy 12.

Figure 2:
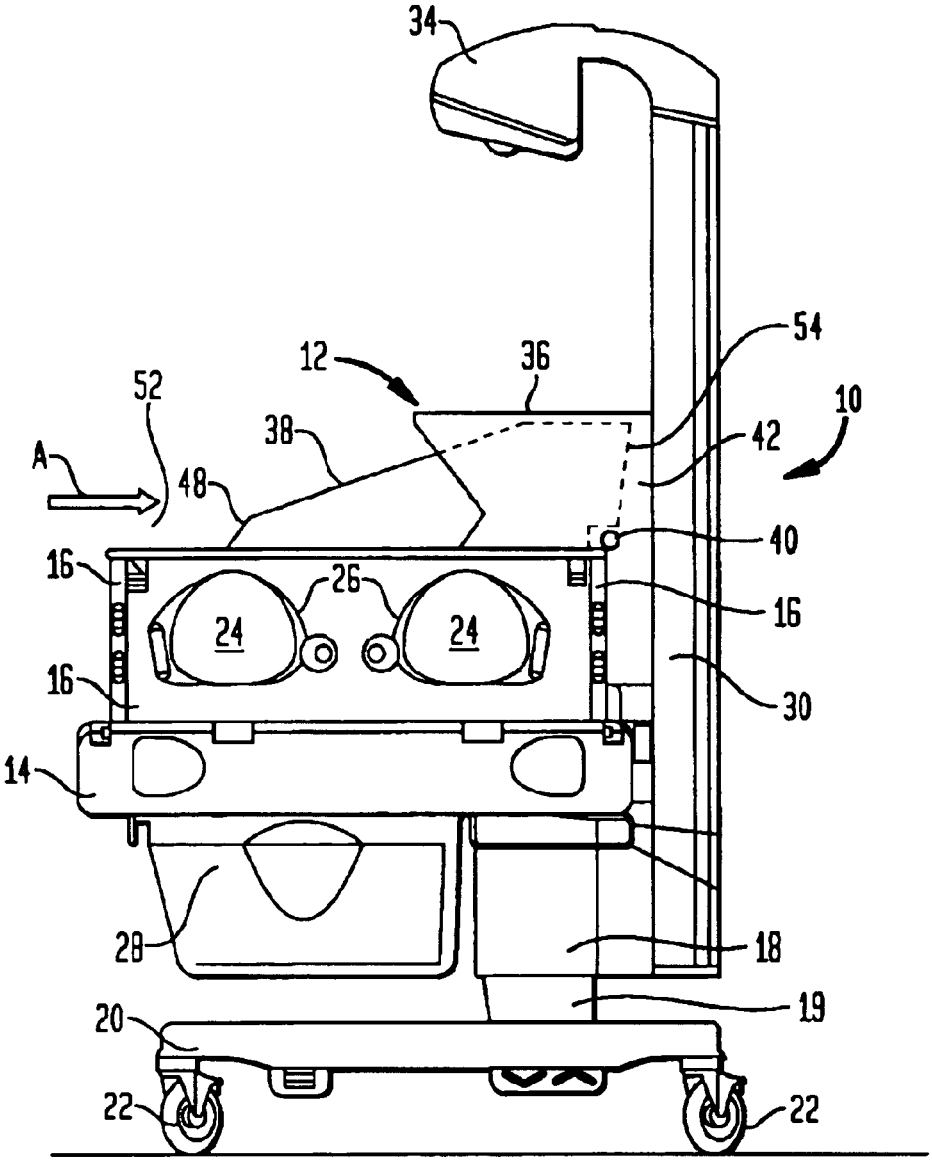
FIG. 2 is a side view of the infant care apparatus of FIG. 1 showing the canopy configured to be moved to its open position.

Turning now to FIG. 2, there is shown a side view of the infant care apparatus 10 where the second section 38 has been slid toward the canopy north end 42 in the direction of the arrow A, thereby shortening the length of the lateral sides of the canopy 12 and forming an opening or open space shown generally at 52. The rear end 54 of the second section 38 has become nested within the interior of the first section 36 in shortening that length while the interlocking of the lower edges continues to maintain the first and second sections 36, 38 affixed together in a sliding relationship. In this position of the first and second sections 36, 38 of FIG. 2, the canopy 12 is ready to be pivoted to its open position where access to the infant can be attained and/or the radiant heater 34 can be energized to warm the infant.

Figure 3:
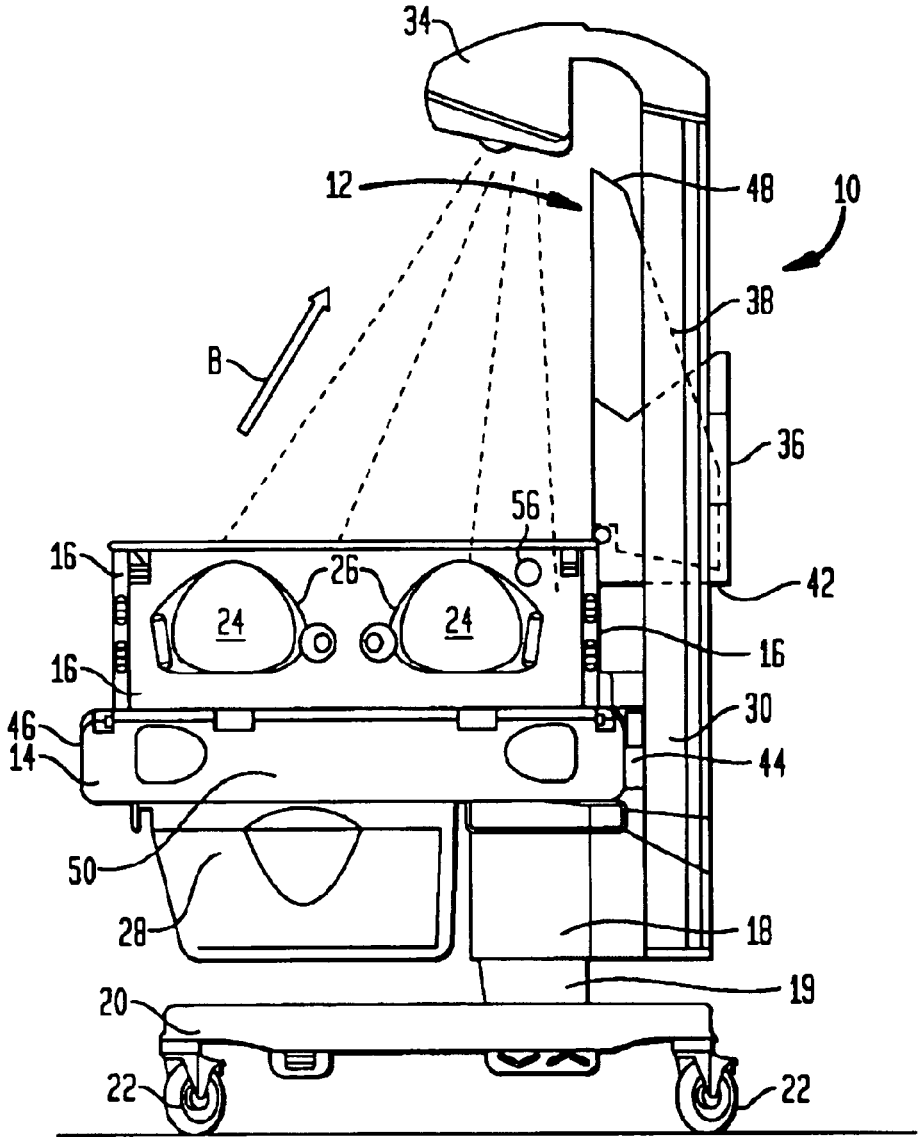
FIG. 3 is a side view of the infant care apparatus of FIG. 1 with the canopy moved to its open position.

Turning now to FIG. 3, there is a side view of the present infant care apparatus 10 where the canopy 12 has been pivoted to its open position. In this Fig., the canopy 12 has been pivoted about the pivot axis 40 in the direction of the arrow B and due to the shortened length brought about by the relative movement of the second section 38 toward the first section 36, the canopy 12 can be pivoted past the radiant heater 34 and that obstruction is avoided and the canopy 12 can be pivoted to an angular, generally vertical orientation so that the radiation by the radiant heater 34 can be directed toward the infant platform 14 without passing through the canopy 12.

As shown, the pivotal movement of the canopy 12 can be carried out manually by the user simply lifting the canopy south end 48, however, in an alternate embodiment, there may be a motor 56, such as a small DC or stepper motor, to carry out the pivoting motion of the canopy 12 as it moves between its open and its closed positions.

Figure 4:
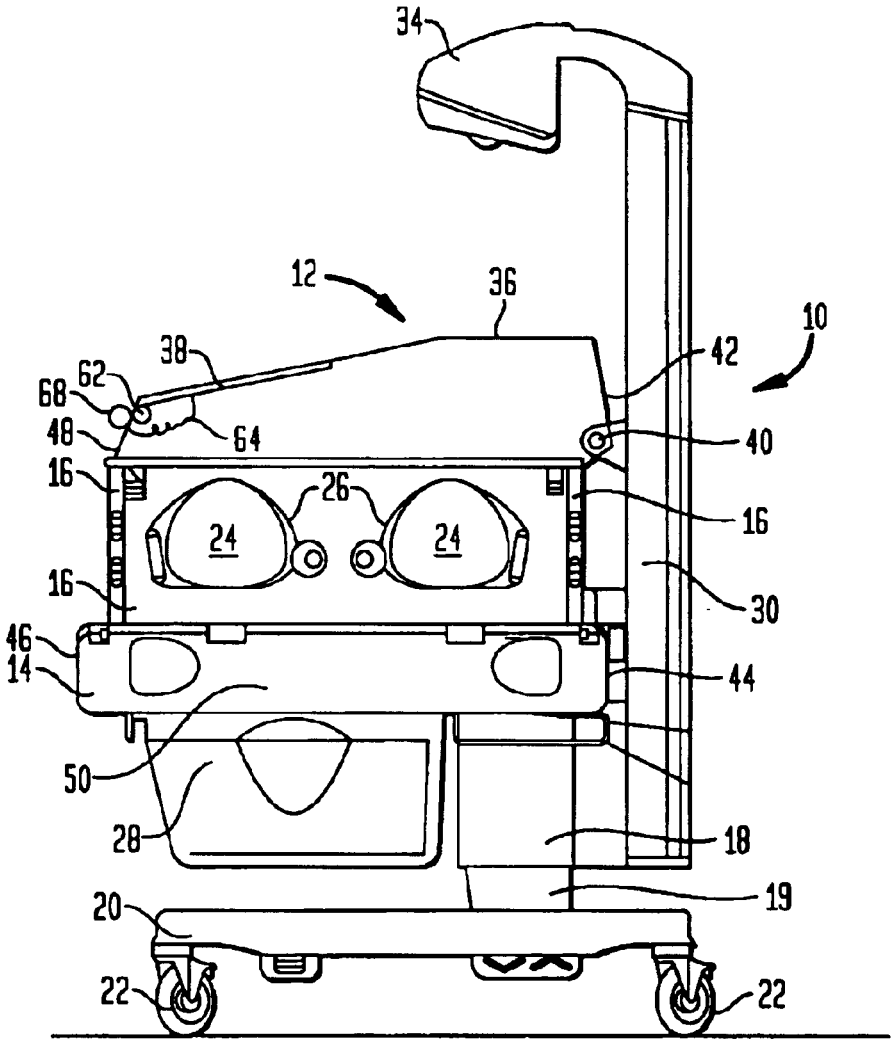
FIG. 4 is a side view of an alternative embodiment of the infant care apparatus incorporating the present invention and showing the canopy in its closed position.

Next, turning to FIG. 4, there is shown a side view of an alternative embodiment and many of the components are the same as in the FIGS. 1–3 embodiment and have been identified with the same numbers. In this embodiment, the first section 36 of the canopy 12 is, again, pivotally affixed with respect to the infant platform 14 by means of the pivot axis 40 and which is located at or proximate to the canopy north end 42. As with the prior embodiment, the canopy 12 can be raised for access to the infant or to convert the infant care apparatus 10 to the infant warmer function by simply lifting the canopy south end 48 about the pivot axis 40.

With this embodiment, however, the second section 38 of the canopy is a trap door 60 that is formed in the canopy 12 and is shown in its closed position in FIG. 4. The trap door 60 is pivotal affixed to the first section 36 of canopy 12 by means of a hinge 62 forming a pivot axis. The trap door 60 is biased toward its closed position and retained in that closed position by a spring 64.

Figure 5:
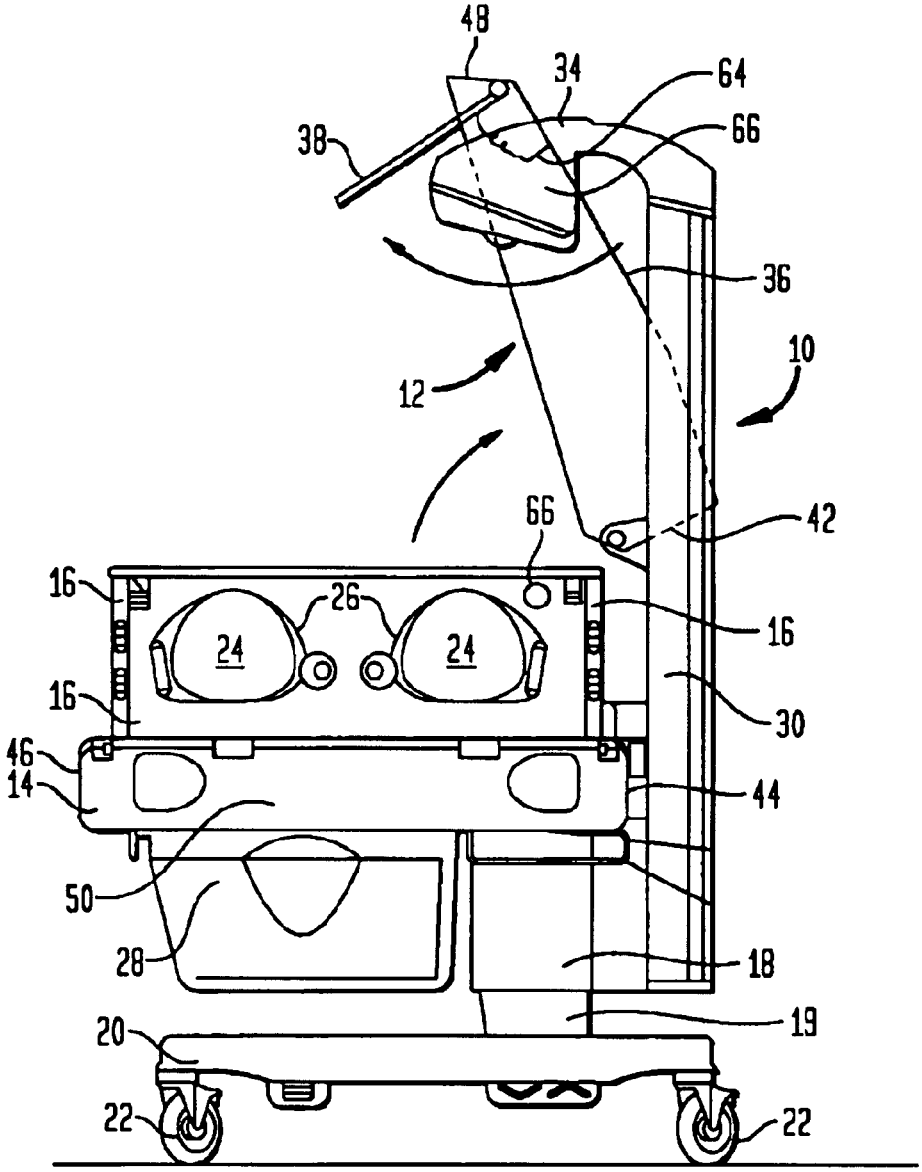
FIG. 5 is a side view of the infant care apparatus of FIG. 4 with the canopy moved to its open position.

Accordingly, turning to FIG. 5, there is a side view of the infant care apparatus 10 of the FIG. 4 embodiment shown with the canopy 12 in its open position. As is illustrated, the raising or pivoting of the canopy 58 has been moved to the location where it has encountered the obstruction, that is, the radiant heater 34. As the canopy 12 encounters that obstruction, the trap door 60 is pushed to its open position against the bias of the spring 64 so that the radiant heater 34 can actual enter and pass through the opening or space 66 in the canopy 12 that is created by the opening of the trap door 60. While only one trap door 60 is illustrated, there may be a plurality of trap doors used consistent with the spirit of the present invention.

Therefore, as with the embodiment of FIGS. 1–3, the canopy 12 can be opened sufficiently to allow the radiant energy emitted by the radiant heater 34 to be directed to the infant platform 14 and not be impeded by the presence of the canopy 12.

As with the prior embodiment, while the canopy 12 of this embodiment can be opened and closed manually there may also be a motor 66 that can be energized to move the canopy 12 between the open and closed positions and even the trap door 60 can be opened and closed by means of a motor 68. As such, therefore, the operation of the canopy 12 and the trap door 60 can be automatically controlled by the user with the trap door 60 normally being opened by means of the motor 68 prior to its encountering the radiant heater 34.

Those skilled in the art will readily recognize numerous adaptations and modifications which can be made to the infant care apparatus of the present invention which will result in an improved telemetry system for an infant care apparatus, yet all of which will fall within the scope and spirit of the present invention as defined in the following claims. Accordingly, the invention is to be limited only by the following claims and their equivalents.

I claim:

1. A infant care apparatus, said infant care apparatus comprising a base having ends and forming an infant platform on which an infant is adapted to be positioned, said infant care apparatus having an obstruction located above the infant platform, a canopy pivotally affixed with respect to said infant platform along an axis located proximate to one of the ends of the infant platform and adapted to overlie an infant when positioned on said infant platform to create an infant compartment enclosing an infant, means to create an open space in said canopy, said open space being aligned with said obstruction so as to allow the canopy to be pivoted about said axis to said open position to allow said canopy to be moved to said open position past said obstruction.

2. The infant care apparatus as defined in claim 1 wherein said infant care apparatus is an infant warming apparatus.

3. The infant care apparatus as defined in claim 2 wherein said obstruction is a radiant heater.

4. A infant care apparatus, said infant care apparatus comprising a base having ends and forming an infant platform on which an infant is adapted to be positioned, said infant care apparatus having an obstruction located above the infant platform, a canopy adapted to overlie an infant when positioned on said infant platform to create an infant compartment surrounding an infant, said canopy having a first section pivotally affixed to the apparatus along an axis located proximate to one of the ends of the infant platform so as to pivot between an open position wherein there is access to the infant and a closed position wherein the infant is enclosed within an infant compartment, said canopy having a second section that can be moved relative to said first section to create an opening in the canopy, said opening being aligned with the obstruction so as to allow the canopy to be pivoted about said axis past said obstruction to said open position from said closed position.

5. The infant care apparatus as defined in claim 4 wherein said second section is pivotally affixed to said first section.

6. The infant care apparatus as defined in claim 5 wherein said second section is a trap door that is biased to a closed position and is moved to create an opening by encountering said obstruction to move said trap door against said bias.

7. The infant care apparatus as defined in claim 5 wherein said infant care apparatus includes a motive means and said second section is moved relative to said first section by means of said motive means.

8. The infant care apparatus as defined in claim 4 wherein said first section is slidably affixed to said second section.

9. The infant care apparatus as defined in claim 4 wherein said obstruction comprises a heater adapted to direct heat toward said infant platform.

10. The infant care apparatus as defined in claim 4 wherein said infant care apparatus includes a motive means operable to move said canopy between its open and closed positions.

11. A infant warming apparatus, said infant warming apparatus comprising a base having ends and forming an infant platform on which an infant is adapted to be positioned, said infant warming apparatus having a radiant heater affixed at one of said ends and located a vertical distance above said infant platform, a canopy adapted to overlie an infant when positioned on said infant platform to create an infant compartment surrounding an infant, said canopy having a first section pivotally affixed to the apparatus along an axis located proximate to one of the ends of the infant platform so as to pivot between an open position wherein there is access to the infant and a closed position wherein the infant is enclosed within an infant compartment, said canopy having a second section that can be moved relative to said first section to create an open space in the canopy, said open space being aligned with the obstruction so as to allow the canopy to be pivoted about said axis to said open position without encountering said obstruction.

12. The infant warming apparatus as defined in claim 11 wherein said infant warming apparatus further includes a warming system to introduce warm air into said infant compartment when said canopy is in said closed position.

13. The infant care apparatus as defined in claim 11 wherein said infant warming apparatus has a vertical member extending upwardly from said one end and said radiant heater is affixed to said vertical member.

14. The infant care apparatus as defined in claim 11 wherein said canopy has a rectangular footprint with long sides and said one end is shorter than said sides.

15. The infant care apparatus as defined in claim 11 wherein said first section is pivotally affixed to the infant care apparatus and said second section is pivotally affixed to said first section.

16. The infant care apparatus as defined in claim 11 wherein said second section is slidably affixed to said first section.

17. A method of using an infant warming apparatus, said method comprising the steps of:

providing an infant warming apparatus having a infant platform and an obstruction vertically displaced above said infant platform at one end thereof, the infant warming apparatus including a canopy that is mounted atop of the infant platform to enclose therein an infant within an infant compartment, the canopy having a first section and a second section;

pivotally affixing the first section with respect to the infant platform along an axis located proximate to one of the ends of the infant platform to allow the canopy to pivot about said axis between a first position where the infant compartment is formed and a second position wherein an infant resting on the infant platform is accessible, displacing the second section of the canopy with respect to the first section to form an open space in the canopy, and aligning the open space with the obstruction, and moving the canopy to its open position past the obstruction.

18. The method as defined in claim 16 wherein the step of displacing the second section with respect to the first section comprises pivoting the second section with respect to the first section.

19. The method as defined in claim 16 wherein the step of displacing the second section with respect to the first section comprises sliding the second section with respect to the first section.

20. The method as defined in claim 16 wherein the step of providing an infant warming apparatus comprises providing an infant warming apparatus wherein the obstruction is a radiant heater.

* * * * *